US006855008B1

(12) United States Patent
Freitag et al.

(10) Patent No.: US 6,855,008 B1
(45) Date of Patent: Feb. 15, 2005

(54) FUSE HOLDER WITH ADJUSTABLE TERMINALS

(75) Inventors: Henrik Freitag, Wood Dale, IL (US); Erik Freitag, Arlington Heights, IL (US)

(73) Assignee: Royal Die & Stamping Co., Inc., Bensenville, IL (US)

( * ) Notice: Subject to any disclaimer, the term of this patent is extended or adjusted under 35 U.S.C. 154(b) by 0 days.

(21) Appl. No.: 10/679,732

(22) Filed: Oct. 6, 2003

(51) Int. Cl.[7] ..... H01R 13/68; H01R 33/95

(52) U.S. Cl. ..... 439/621

(58) Field of Search ..... 439/621, 725–729, 439/754–756, 366, 763, 764

(56) References Cited

U.S. PATENT DOCUMENTS

| | | | | |
|---|---|---|---|---|
| 1,661,375 | A | | 3/1928 | Leighton |
| RE26,486 | E | | 11/1968 | Haegert |
| 3,568,138 | A | | 3/1971 | Bakker |
| 3,922,058 | A | | 11/1975 | Kinnear |
| 4,054,355 | A | | 10/1977 | Kourimsky et al. |
| 4,063,794 | A | | 12/1977 | Dittmann |
| 4,126,367 | A | | 11/1978 | Miller |
| 4,354,726 | A | | 10/1982 | Kato et al. |
| 5,087,214 | A | | 2/1992 | Dewar |
| 5,169,338 | A | | 12/1992 | Dewar et al. |
| 5,183,419 | A | | 2/1993 | Dewar |
| 5,221,219 | A | | 6/1993 | Thomson |
| 5,252,091 | A | | 10/1993 | Fujita et al. |
| 5,290,646 | A | | 3/1994 | Asao et al. |
| 5,302,142 | A | | 4/1994 | Tabata |
| 5,302,143 | A | | 4/1994 | Inoue et al. |
| 5,316,505 | A | | 5/1994 | Kipp |
| 5,346,407 | A | | 9/1994 | Hood |
| 5,389,466 | A | | 2/1995 | Inoue et al. |
| 5,431,580 | A | | 7/1995 | Tabata |
| 5,445,907 | A | | 8/1995 | Ito et al. |
| 5,454,741 | A | | 10/1995 | Okada |
| 5,466,164 | A | | 11/1995 | Miyazaki et al. |
| 5,486,119 | A | | 1/1996 | Nabeshima et al. |
| 5,486,123 | A | | 1/1996 | Miyazaki |
| 5,486,434 | A | | 1/1996 | Aoyama |
| 5,492,780 | A | | 2/1996 | Okada |
| 5,498,178 | A | | 3/1996 | Tabata |
| 5,599,210 | A | | 2/1997 | Green |
| 5,672,442 | A | | 9/1997 | Burnett |
| 5,711,688 | A | | 1/1998 | Matsunaga et al. |
| 5,733,152 | A | | 3/1998 | Freitag |
| 5,738,552 | A | | 4/1998 | Halbach et al. |
| 5,800,219 | A | | 9/1998 | Siedlik et al. |
| 5,877,609 | A | * | 3/1999 | Carter ..... 320/103 |
| 5,879,202 | A | | 3/1999 | Zhao |
| 5,941,738 | A | | 8/1999 | Matsunaga et al. |
| 6,162,098 | A | * | 12/2000 | Cheng et al. ..... 439/621 |
| 6,250,973 | B1 | | 6/2001 | Lowery et al. |

* cited by examiner

*Primary Examiner*—Javaid H. Nasri
(74) *Attorney, Agent, or Firm*—Wallenstein Wagner & Rockey, Ltd.

(57) ABSTRACT

A fuse holder (10) comprising an enclosure for removably containing an electrical fuse (42). The fuse holder (10) includes at least a first (50) and a second electrically conducting terminal (52), preferably made of copper or a copper alloy. Each of the first (50) and second electrically conducting terminals (52) is in electrical contact with the fuse (42) through one or more electrically conducting elements (64, 66). The first electrically conductive terminal (50) is rotatably movable relative to the second electrically conductive terminal (52). The enclosure is comprised of a first piece (12) and a second piece (14) that is threadably secured to the first piece (12). When the first (12) and second pieces (14) are secured, they hold the fuse (42) snugly within the enclosure. The second piece (14) may include either a polygonal perimeter or a plurality of notches (68, 70, 72, 74, 76, 78) along the perimeter. In the event that the second piece (14) has a polygonal perimeter, the electrically conducting terminal (50) includes at least a first tab (56) and a second tab (58) abutting against two of the sides of polygonal perimeter. Where the second piece (14) has a perimeter having a plurality of notches (68, 70, 72, 74, 76, 78), the electrically conducting terminal (50a) includes at least one tongue (80) that is insertable into one of the notches (68, 70, 72, 74, 76, 78).

16 Claims, 2 Drawing Sheets

FIG. 5
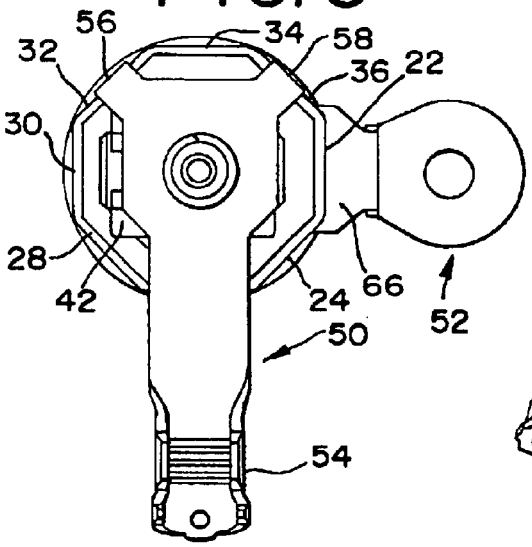
FIG. 6
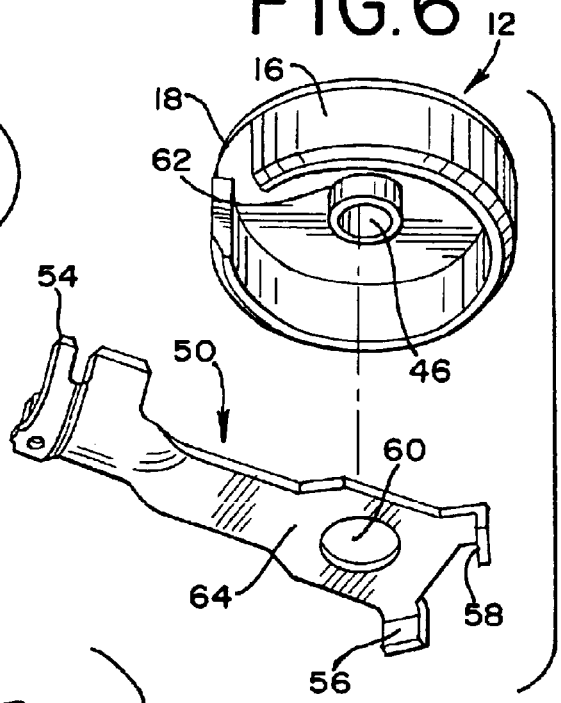
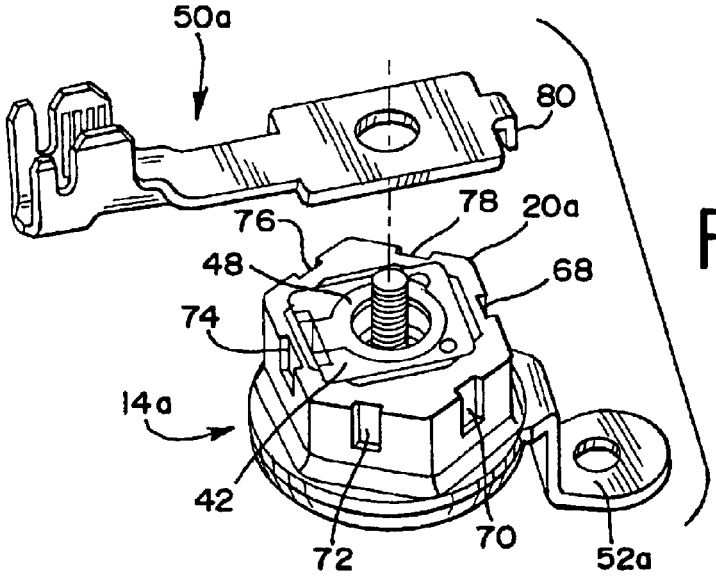
FIG. 7
FIG. 8
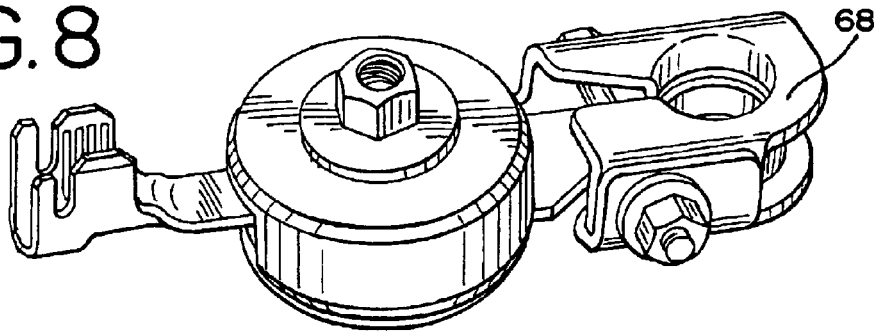

FUSE HOLDER WITH ADJUSTABLE TERMINALS

TECHNICAL FIELD

This invention is directed to a fuse holder with adjustable terminals. The fuse holder can be opened so that the user can gain access to, and readily replace, a burned or shorted fuse.

BACKGROUND OF THE INVENTION

Electricity is necessary for the operation of most major powered systems and subsystems of modern motor vehicles. The electricity is stored in a common electrical storage battery. As the current is drawn from the electrical storage battery, that battery must be recharged. In virtually all modern motor vehicles, the battery is recharged by an alternator driven by a belt powered by the vehicle's engine.

The many electrical circuits, or the cables that can be a part of those circuits, are typically protected by fuses. Some of these fuses may be located in remote fuse boxes. Other such fuses can be placed directly inside of, i.e., contained within, the wires or cables to be protected.

An example of this latter structure is the cable that is typically placed between the positive terminal of the storage battery and the alternator. When an overvoltage or overcurrent situation occurs, and as a result, the in-line fuse of this battery-to-alternator cable blows, the car must be immediately serviced. Because the fuse is contained entirely within the damaged cable, it is not accessible by the vehicle owner, and cannot be replaced. In fact, the inability to see or gain access to the fuse prevents the owner from visually establishing that the fuse has in fact blown. Thus, such service can normally be accomplished only by driving or towing the vehicle to a service or repair facility.

In some vehicles, the cable that is placed between the positive terminal of the battery and the alternator does not have a fuse that is contained within that cable. Rather, the fuse that protects this cable is connected to one end of that cable. That fuse is permanently secured to a bracket having two ends. The bracket is typically made of a rigid, electrically conductive material, such as copper or a copper alloy. The two end terminals of this bracket may be disposed directly opposite each other at a relative angle of 180°, or they may be offset relative to each other, at various acute or obtuse angles, depending upon the needs of the vehicle manufacturer, and the configurations and underhood spacing of the vehicles produced by that manufacturer. Many different bracket configurations, with various angles between their two end terminals, are necessary to satisfy the various needs of these manufacturers. Moreover, as a result of the permanent securement of the fuse to this bracket, replacement of a blown fuse requires replacement of the entire fuse/bracket assembly. The permanent securement of the fuse to the bracket prevents the replacement of the fuse alone.

Accordingly, there is a need for an improved fuse holder that will solve these problems with the prior art fuse holders, and with the prior art bracket/fuse assemblies.

SUMMARY OF THE INVENTION

The invention is a fuse holder. The fuse holder comprises an enclosure for removably containing an electrical fuse. The fuse holder also includes at least a first and a second electrically conducting terminal, preferably made of copper or a copper alloy. Each of the first and second electrically conducting terminals is in electrical contact with the fuse through one or more electrically conducting elements. In one preferred embodiment, the electrically conducting element and the first terminal are made of one piece. The first electrically conductive terminal is movable relative to the second electrically conductive terminal.

In another aspect of the invention, the first terminal and the second terminal are movable relative to each other along a generally horizontal plane. In yet another aspect of the invention, the first terminal is rotatably movable relative to the second terminal.

Preferably, the enclosure is comprised of a fist piece and a second piece. The first piece is threadably secured to the second piece. When the first and second pieces are secured, they hold the fuse snugly within the enclosure.

The second piece may include either a polygonal perimeter or a plurality of notches along the perimeter. In the embodiment in which the second piece has a polygonal perimeter, the preferred structure is either a hexagonal or octagonal perimeter. Moreover, in the embodiment in which the second piece has such a polygonal perimeter, the electrically conducting element includes at least a first tab and a second tab. The first tab abuts against at least a first side of the polygonal perimeter, while the second tab abuts against at least a second side of the polygonal perimeter.

With the embodiment where the second piece has a perimeter having a plurality of notches, the electrically conducting element includes at least one tongue that is insertable into one of the notches.

The second terminal of the fuse holder may be secured by overmolding that second terminal into the second piece of the enclosure.

BRIEF DESCRIPTION OF THE DRAWINGS

FIG. 5 is a view of the two fully assembled, lower-most components of FIG. 4, but with the upper of the two components turned 90° from the position in which it is shown in FIG. 4.

FIG. 6 is a view of the underside of the first piece of FIG. 1, and of the first electrically conducting terminal.

FIG. 7 is a perspective view of a second embodiment of a fuse holder of the invention.

FIG. 8 is a perspective view of a third embodiment of a fuse holder in accordance with the invention.

DETAILED DESCRIPTION

There are many possible embodiments of this invention. The drawings and description below describe in detail several preferred embodiments of the invention. It should be understood that the present disclosure is to be considered as an example of the principles of the invention. The disclosure is not intended to limit the broad aspect of the invention to the embodiments illustrated.

Figure 1:
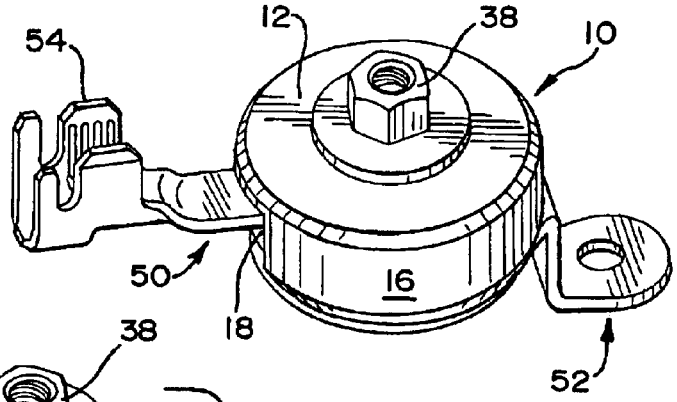
FIG. 1 is a perspective view of one embodiment of a fuse holder of the invention.

Referring to the drawings, FIG. 1 shows a preferred embodiment of the fuse holder 10 of the invention. This fuse holder 10 is intended for placement, as by splicing, into the cable that is typically placed between the positive terminal of the storage battery and the alternator of a motor vehicle. The fuse holder 10 will contain a fuse 42 that is readily replaceable by the owner or operator of the motor vehicle when that fuse has been blown under an overcurrent or overvoltage condition that arises in the cable between the storage battery and the alternator.

The use of the fuse holder 10 is highly advantageous over current cables, where the fuse is internally contained in the battery-to-alternator cable. As a result of this internal containment in these prior art cables, the fuse cannot be seen, and thus the condition of the fuse cannot be assessed. Even if the fuse could be seen and determined to be blown, the containment of the fuse entirely within the cable prevents that fuse from being either accessed or serviced by the owner or operator of the motor vehicle. In contrast, with the fuse holder 10 of the invention, the fuse can be seen, assessed, accessed, and changed by the owner or operator.

Figure 2:
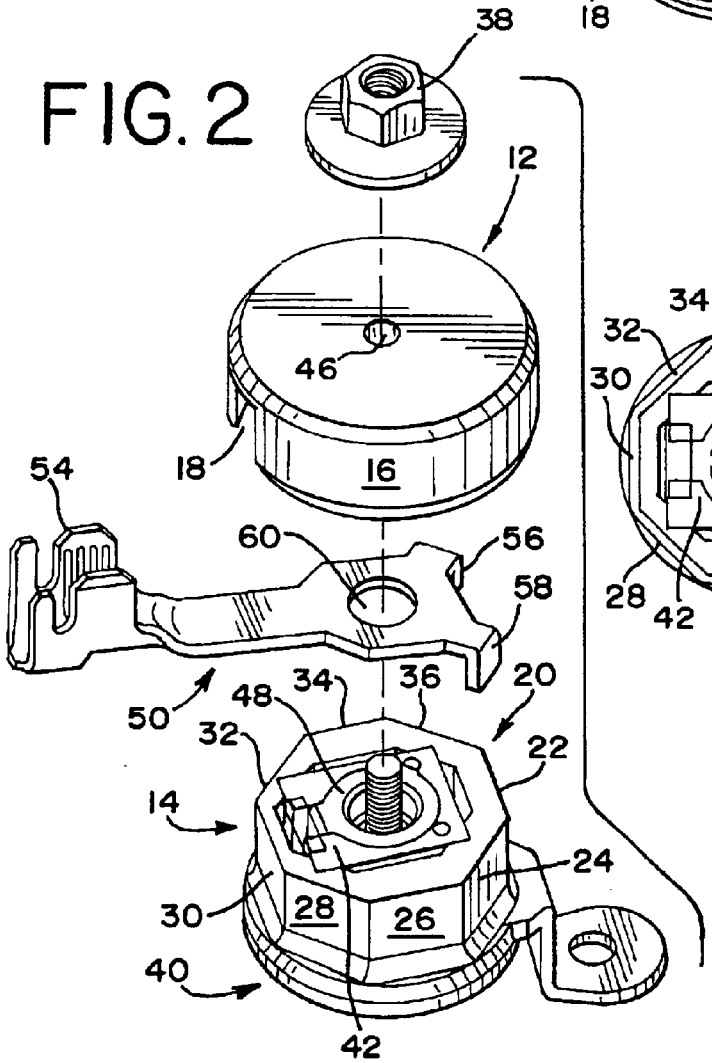
FIG. 2 is an exploded view of four components of the fuse holder shown in FIG. 1.

As may be seen in FIG. 2, an exploded view of the fuse holder 10 of FIG. 1, the fuse holder 10 comprises a two-piece enclosure for removably containing an electrical fuse. In particular, the fuse holder 10 is comprised of a first piece 12 and a second piece 14. The first 12 and second pieces 14 are formed so that when brought together in a face-to-face relationship, they fit together snugly. In this embodiment, as may best be seen in FIGS. 1 and 2, the first piece 12 is cylindrical, and is the uppermost of the two pieces 12 and 14. The inner diameter of this first piece 12 is approximately 1.5 inches, and the outer diameter of this first piece 12 is approximately 1.75 inches. As may be seen in FIG. 6, and as will be explained more extensively below, side wall 16 of the first piece 12 includes a slot 18 through which one of the terminals extends.

Figure 3:
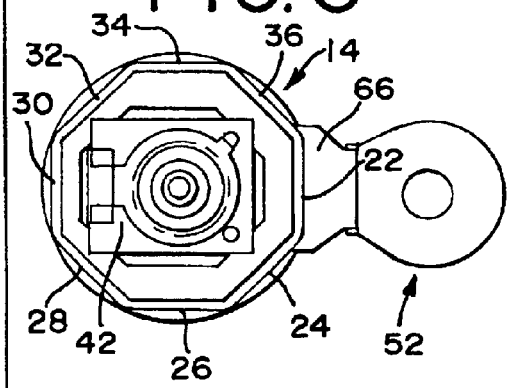
FIG. 3 is a top or overhead view of the lower-most component of the four components shown in FIG. 2.

As may best be seen in FIG. 2, the upper portion 20 of this second piece 14 of the fuse holder 10 has a polygonal perimeter, here, an octagonal outer surface. There are eight flat portions 22, 24, 26, 28, 30, 32, 34, and 36, or "flats," that make up this octagonal outer surface, as may best be seen in FIG. 3. Each of these eight flats has a length of approximately 0.5 inch, and a height of approximately 0.375 inch. The lower portion 40 of this second piece 14 has a generally rounded, circular configuration.

When the first piece 12 is brought together with the second piece 14, the entire octagonal outer surface and flats 22, 24, 26, 28, 30, 32, 34, and 36 of the second piece 14 are covered and obscured by the side wall 16 of the first piece 12. While the first 12 and second pieces 14 are brought together, they fit together snugly. However, in order to ensure that these two pieces 12 and 14 remain together while encountering the severe and repeated vibrational and centrifugal forces typical during the operation of an automobile, the first piece 12 is threadably secured to the second piece 14 with a hex-head nut 38. When the first 12 and second pieces 14 are secured in this manner, they hold the replaceable fuse 42 snugly within the fuse holder 10.

As may be seen in FIG. 2, to threadably secure the first piece 12 to the second piece 14, a vertically oriented, threaded rod 44 is molded into the second piece 14 of the fuse holder 10. When the first 12 and second pieces 14 are brought together, threaded rod 44 passes through an aligned, circular orifice 46 (see FIG. 2) formed in the upper surface of the first piece 12. The first piece 12 and second piece 14 are held snugly together by rotatably fastening the hex head nut 38 onto the threaded rod 44 until that nut 38 abuts firmly against the top of the first piece 12.

The fuse holder 10 also includes at least a first electrically conducting terminal 50 and a second electrically conducting terminal 52. In this embodiment, the first electrically conducting terminal 50 is associated with the first piece 12 of the fuse holder 10. The second electrically conducting terminal 52 is associated with, and secured to, the second piece 14 of the fuse holder 10.

As may best be seen in FIGS. 2 and 6, the first electrically conducting terminal 50 of this embodiment is made of one piece. In this embodiment, the first electrically conducting terminal 50 is preferably made of either copper or a copper alloy. One distal end of the terminal 50 includes a grip portion 54 onto which the uninsulated end of a wire may be crimped. The other distal end of the terminal 50 includes a pair of tabs, i.e., a first tab 56 and a second tab 58. An intermediate portion of the terminal includes a circular opening 60.

When the first 12 and second pieces 14 of the fuse holder 10 are positioned adjacent each other to form the fuse holder 10, the first terminal 50 is captured between and contained by the first piece 12 and second piece 14. As may be seen in FIGS. 5 and 6, the circular opening 60 of the first electrically conducting terminal 50 is captured by post 62 on the underside of that first piece 12. As may best be seen in FIG. 1, the grip portion 54 of the first electrically conducting terminal 50 projects outwardly through the slot 18 in the side wall 16 of the fust piece 12.

Figure 4:
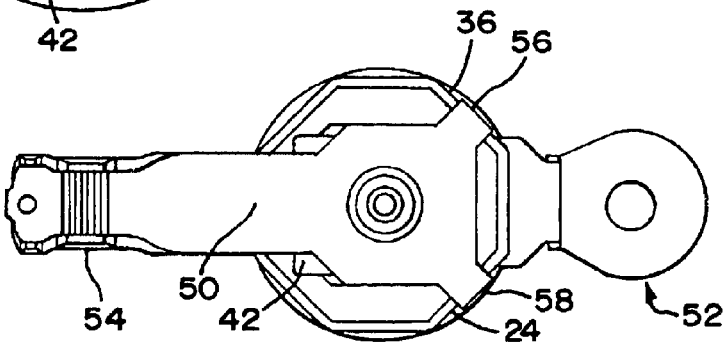
FIG. 4 is a top or overhead view of the two fully assembled, lower-most components of the four components shown in FIG. 2.

As may be seen in FIGS. 4 and 5, when the fuse holder 10 is assembled, the tabs 56 and 58 abut against two of the flats, particularly, flats 36 and 24, respectively. As a result of this abutment, the first terminal 50 is rigidly held, in a stationary configuration, and prevented from rotating about the second piece 14. When the tabs 56 and 58 abut flats 36 and 24, respectively, the first terminal 50 is positioned at an angle of 180° from the second terminal 52.

The relative position of the terminals 50 and 52 may be adjusted by moving the tabs 56 and 58 so that they abut other flats along the octagonal periphery of the second piece 14. For example, as may best be seen in FIG. 5, when the tabs 56 and 58 are moved so that they abut flats 32 and 36, respectively, terminal 50 is positioned 90°, rather than 180°, from terminal 52.

It will be understood that if tabs 56 and 58 are moved to abut against flats 30 and 34, respectively, first electrically conductive terminal 50 is positioned 45° from second electrically conductive terminal 52. By placing the tabs 56 and 58 at appropriate flats, terminals 50 and 52 can be placed at angles of 45° (flats 30 and 34), 90° (flats 32 and 36), 135° (flats 34 and 22), 180° (flats 36 and 24), 225° (flats 22 and 26), 270° (flats 24 and 28), or 315° (flats 26 and 30) relative to each other, as measured in a clockwise direction from terminal 50 to 52, respectively.

From the above, it can be appreciated that the first terminal 50 and the second terminal 52 are rotatably movable relative to each other along a generally horizontal plane.

Each of the first and second electrically conducting terminals 50 and 52 is in electrical contact with a fuse 42 through one or more electrically conducting elements. The fuse 42 itself has a conductive upper ring-shaped surface 48 on its topside and a conductive lower surface (not shown) on its bottom side.

One electrically conducting element 64 is a flat, intermediate portion of the first terminal 50. Another electrically conducting element 66 is a separate flat, intermediate portion of the second terminal 52. In this preferred embodiment, the electrically conducting element 64 is of one piece with the first terminal 50, while the electrically conducting element 66 is of one piece with the second terminal 52.

As noted above, in the first embodiment, the second piece 14 includes a polygonal perimeter. In yet another embodiment, as may be seen in FIG. 7, the periphery along the upper portion 20 of second piece 14 may include a plurality of notches 68, 70, 72, 74, 76, and 78. In this embodiment, the first electrically conducting terminal 50*a* includes at least one tongue 80 that is insertable into one of the notches 68, 70, 72, 74, 76, or 78. When this tongue 80 is inserted into one of these six notches, the first terminal 50*a* is rigidly held, in a stationary configuration, relative to the second terminal 52*a*. As may be seen in FIG. 7, when tongue 80 is placed in notch 68, the first terminal 50*a* is at an angle of 180° relative to the second terminal 52*a*. As may be appreciated from FIG. 7, when tongue 80 is placed in notch 76, the first terminal 50*a* would be at an angle of 60° relative to the second terminal 52*a*.

In both of the above embodiments, the second terminal 52 or 52*a* of the fuse holder 10 may be secured by overmolding that second terminal 52 or 52*a* into the second piece 14 or 14*a*.

In yet another embodiment, shown in FIG. 8, the second terminal 14 or 14*a* is a battery terminal connector 68.

It is understood that, given the above description of the embodiments of the invention, various modifications may be made by one skilled in the art. Such modifications are intended to be limited only by the scope of the below claims.

What is claimed is:

1. A fuse holder, said fuse holder comprising: an enclosure for removably containing an electrical fuse; at least a first and a second electrically conducting terminal, said first electrically conducting terminal being of one piece with a first electrically conducting element, and said second electrically conducting terminal being of one piece with a second electrically conducting element, and each of said first and second electrically conducting terminals being in electrical contact with said fuse through its respective electrically conducting element; said first electrically conducting terminal being movable relative to said second electrically conducting terminal.

2. The fuse holder of claim 1, wherein said first terminal and said second terminal are movable relative to each other along a generally horizontal plane.

3. The fuse holder of claim 1, wherein said first terminal is rotatably movable relative to said second terminal.

4. The fuse holder of claim 1, wherein said enclosure is comprised of a first piece and a second piece.

5. The fuse holder of claim 4, wherein said first piece is threadably secured to said second piece.

6. The fuse holder of claim 4, wherein said second piece has a polygonal perimeter.

7. The fuse holder of claim 4, wherein said second piece has a hexagonal perimeter.

8. The fuse holder of claim 4, wherein said second piece has an octagonal perimeter.

9. The fuse holder of claim 6, wherein said electrically conducting element includes at least a first tab and a second tab, said first tab abutting against at least a first side of said polygonal perimeter, and said second tab abutting against at least a second side of said polygonal perimeter.

10. The fuse holder of claim 4, wherein said second piece has a perimeter having a plurality of notches formed along said perimeter.

11. The fuse holder of claim 10, wherein said electrically conducting element includes at least one tongue that is insertable into one of said notches.

12. The fuse holder of claim 4, wherein said second terminal is secured by overmolding into said second piece.

13. The fuse holder of claim 1, wherein said first and second electrically conducting terminals are made from copper.

14. The fuse holder of claim 1, wherein said first and second electrically conducting terminals are made from a copper alloy.

15. The fuse holder of claim 1, wherein said electrically conducting element and said first terminal are made of one piece.

16. The fuse holder of claim 1, wherein said second electrically conducting terminal is a battery terminal connector.

* * * * *